United States Patent [19]

Amancharla

[11] 4,232,888

[45] Nov. 11, 1980

[54] WIRELINE RELEASABLE SEAL CONNECTOR FOR WELLPIPE STRINGS

[75] Inventor: Amareswar Amancharla, League City, Tex.

[73] Assignee: Baker International Corporation, Orange, Calif.

[21] Appl. No.: 916,719

[22] Filed: Jun. 19, 1978

[51] Int. Cl.[3] ..... E21B 17/046

[52] U.S. Cl. ..... 285/18; 166/125; 285/82

[58] Field of Search ..... 285/18, 82, 39; 166/125, 153–155, 348, 344, 345

[56] References Cited

U.S. PATENT DOCUMENTS

| | | | |
|---|---|---|---|
| 3,037,797 | 6/1962 | Brown | 285/18 |
| 3,136,366 | 6/1964 | Brown et al. | 166/125 X |
| 3,287,030 | 11/1966 | Crain et al. | 166/348 |
| 3,915,226 | 10/1975 | Savage | 285/18 |

*Primary Examiner*—William F. Pate, III

*Attorney, Agent, or Firm*—Subkow and Kriegel

[57] ABSTRACT

A wireline releasable sealing connector is connected in a tubular pipe string together with a packer which is adapted to be set in the well casing. The connector is releasable and connectable without rotation of the pipe-string. Tension is transmitted through the connector by a latching collet which is locked against release in response to relative longitudinal movement between an outer body and an inner sealing mandrel, unless, while the connector is in compression, a wireline tool is seated within the connector and engages a connector collet and thereby prevents locking of the latching collet.

17 Claims, 4 Drawing Figures

WIRELINE RELEASABLE SEAL CONNECTOR FOR WELLPIPE STRINGS

It is a common practice in the completion and production of wells, such as oil and gas wells, to install within the wellbore casing a casing packer which forms a seal between a string of tubing and the wall of the casing and is anchored in engagement with the casing, either mechanically or hydraulically.

In order to enable retrieval of the running pipe or tubing string above the packer, by releasing the tubing from the packer, for various reasons, including the repair of the tubing string, the servicing of valve mechanisms in the tubing string, such as, for example, gas lift valves, releasable or on-off sealing connectors have been employed above the packer enabling release of the upwardly extended tubing string. Such sealing connectors typically require tubing manipulation, namely, rotation of the tubing to effect the coupling or uncoupling of such connectors.

Such releasable connectors pose problems in certain wells wherein rotative manipulation of the tubing string above the packer to effect coupling or uncoupling of the connector is difficult if not impossible. For examples, the tubing string may contain valve mechanisms such as safety valve devices or gas lift valve devices. If the wellbore is crooked or at a substantial angle to the vertical, rotative manipulation of the tubing string is difficult to accomplish or can be damaging to the control fluid pressure lines for the safety valves or to the gas lift mandrels which can render rotation of the tubing impossible in very crooked or steeply sloped wellbores.

The present invention relates to a releasable sealing connector for use in pipe or tubing strings installed in a well casing which eliminates the problems referred to above.

More particularly, the present invention relates to a releasable seal connector which can be uncoupled and recoupled by simple longitudinal movement of the running string. The connector is so constructed that tension can be applied to the tubing string resulting in the connector being positively locked together, but when the connector is subjected to compression and a wireline retrievable tool is seated within the connector, the subsequent application of tension to the running string effects release of the connector and enables retrieval of the tubing string above the connector to the top of the wellbore.

In accomplishing the foregoing, the present invention provides an outer, upper assembly or housing structure adapted to be connected to an upwardly extended tubing string and an inner sealing mandrel structure adapted to be connected to a downwardly extended tubing string or to a packer or other related device extending downwardly in the wellbore. The outer housing carries a seal slidably and sealingly engaged with the exterior of the inner sealing mandrel. Between the housing and the mandrel is a collet latch structure, including a lower collet latch and an upper collet latch, the lower collet latch normally retaining the outer housing and the sealing mandrel coupled together when tension is applied to the tubing string, due to the coengagement of a portion of the outer housing with the lower collet latch to prevent release thereof from the sealing mandrel in response to the tension forces. An upper collet latch is provided which normally enables limited longitudinal upward movement of the outer housing with respect to the lower collet for coengagement upon the application of tension to the running tubing string. However, when the tubing string applies a compressive load to the housing, the upper latch is adapted to be locked to the housing by the insertion of a wireline tool into the connector, thereby preventing the limited upward movement of the outer housing structure required for coengagement with the lower collet, when tension is again applied to the tubing, so that the outer housing cannot engage the lower latch fingers to prevent their release in response to the applied tension. Without coengagement between the outer housing and the lower collet latch, the lower collet latch can release from the sealing mandrel and the outer housing and sealing mandrel can uncouple when tension is applied to the tubing.

In order to prevent the outer, upper housing assembly and the inner mandrel from reciprocating relative to one another during running of the string of tools in the tubing, it is preferred that the housing assembly be initially releasably connected to the mandrel by means which can be overcome when tension is initially applied to the running tubing string.

Before the connector is released for retrieval of the tubing, for example to repair the tubing or to recover a gas lift valve for service, or the like, the well zone below the packer can be sealed off or isolated by running a blanking plug on a wireline tool into the mandrel of the connector. Accordingly, the interior of the mandrel of the connector is provided with a seat for such a blanking tool including a latching groove, and a blanking plug is provided engageable within the seat and having means engageable within the groove to retain the blanking plug in place.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
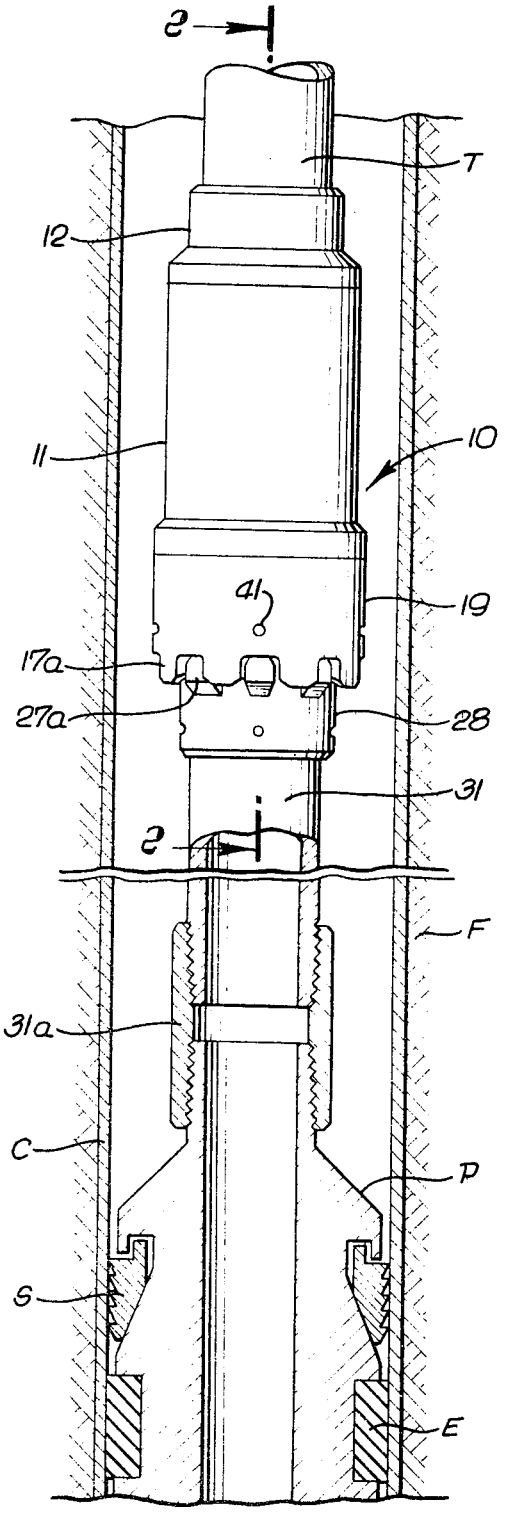
FIG. 1 is a view partly in longitudinal section and partly in elevation diagrammatically illustrating a well casing packer anchored in a well casing in a tubing string which includes a releasable sealing connector in accordance with the invention.

Referring first to FIG. 1, a well casing C is shown as being set in a well bore extending into or through earth formation F. Disposed within the well casing C and anchored and set therein is a packer assembly P, including normally retracted but expanded slip elements S disposed in anchoring engagement with the casing, and a normally retracted but resiliently deformed, elastomeric packing structure E which forms a seal within the casing C. Initially the packer assembly P is run into the well casing on a tubing or pipe string T, the upwardly extending portion (not shown) of which may contain various structures which project outwardly therefrom, such as for example, gas lift mandrels containing lift valves whereby production fluid from a subterranean earth formation can be produced upwardly through the packed off tubing to the top of the well. Located in the tubing string T above the packer structure P is a releasable sealing connector 10 forming a releasable and sealed connection between the upwardly extending tubing string and the packer structure below the connector 10 which, as will be later described enables the upwardly extending tubing string T to be released from the packer and recovered to the top of the well for various purposes, such as, for example, the repair or replacement of gas lift valves. In the case of certain wells drilled at large angles, or wherein the bore hole is relatively crooked, the release of the prior art connectors between the packer and the upwardly extending tubing string has been difficult or damaging to such devices as gas lift mandrels, due to the fact that the tubing string tends to rest against the low side of the casing or engage the various crooked walls of the casing as it extends through the crooked hole. Under such circumstances rotation of the tubing string to effect the release of a connector has been a problem.

The connector 10, of the present invention, is adapted to be released in response to simple longitudinal motion of the tubing string, but the connector is normally latched together so that either tension or compression can be applied through the connector through the tubing string and to the packer.

Figure 2:
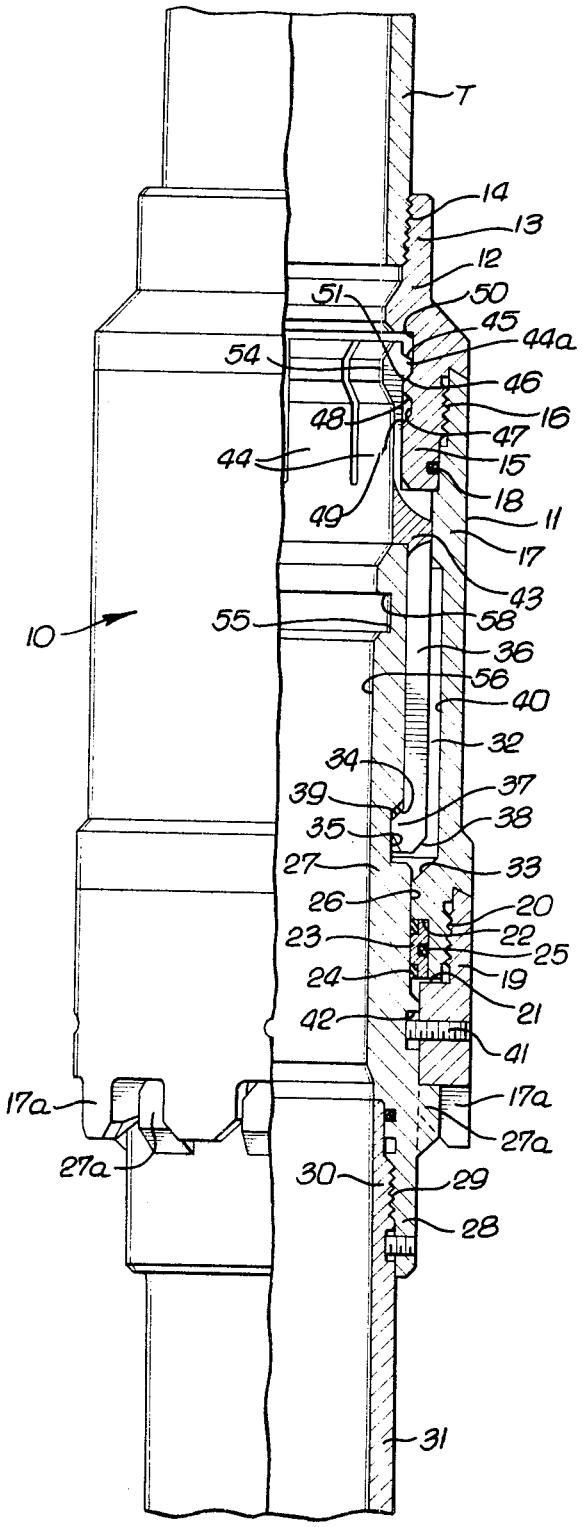
FIG. 2 is an enlarged view partly in section and partly in elevation showing the sealing connector in a condition for running the packer into the well casing on the tubing string.

Referring to FIG. 2, it will be seen that the connector assembly 10 includes an outer, upper housing assembly 11 including an upper connector head member 12 having an internally threaded neck 13 threadedly connected at 14 to the lower end of the tubing T. A lower skirt section 15 of the connector head has an external threaded connection 16 with a downwardly extended housing 17 of tubular form, a suitable O-ring or side ring seal 18 being disposed at the threaded connection. Adjacent to its lower end, the housing section 17 has a lower housing member 19 threadedly connected thereto at 20 and providing an upwardly facing internal shoulder 21 opposed to an internal downwardly facing shoulder 22 within a reduced internal diameter section of the housing, with a sealing structure 23 confined between the opposed shoulders 21 and 22. The sealing structure 23 has internal packing or sealing ring means 24 and an external resilient seal ring 25 engaged with the outer housing member. The internal seal rings 24 are adapted for slidable and sealing engagement with the external cylindrical surface 26 of a tubular sealing mandrel 27. This mandrel 27 at its lower end has an internally threaded skirt or box 28 threadedly connected at 29 to the upper end 30 of a tubular member 31 connected by a coupling **31*a* to the packer structure P. It will be understood however that the lower end 28 of the seal mandrel 27 can also be connected to other tubular devices or tubular extensions between the connector 10 and the packer P. Between the outer housing 17 and the inner mandrel 27 is an annular space 32, at the lower end of which the housing 17 has an internal, downwardly and inwardly inclined surface or shoulder 33 disposed in opposed relation to a downwardly and inwardly inclined shoulder or surface 34 provided on the inner mandrel 27 at the upper side of an external annular groove 35** therein.

A plurality of circumferentially spaced, resilient, lower collet latch fingers 36 extend downwardly through the annular space 32 and have at their lower ends inwardly projecting lugs 37 providing a downwardly and inwardly inclined lower surface 38 and an inner, downwardly and inwardly inclined surface or shoulder 39, respectively opposed by the housing shoulder 33 and the mandrel shoulder 34. In the position of FIG. 2, the shoulders 33 and 34 are longitudinally spaced, and the internal bore 40 of the outer housing 17 is of an enlarged diameter such that the collet fingers 36 can, upon upward movement, be flexed or cammed radially outwardly by coengagement of the opposing lug and mandrel surfaces 34 and 39 into the space provided in the housing 17.

The outer body and the inner mandrel are preferably, though not necessarily for reasons which will become apparent, held in the relative positions shown in FIG. 2 by suitable shear screws 41 threaded into the lower housing member 19 and extended into a recess 42 adjacent the lower end of the inner mandrel 27. Relative rotation of the outer body structure and the inner mandrel 27 is prevented by a number of circumferentially spaced downwardly projecting lugs **17*a* on the body member 19 which interfit between companion spaced lugs 27*a* spaced about the seal mandrel or inner body 27**.

The latching or collet fingers 36 are formed on a circumferentially extended sleeve or body section 43 which is disposed within the upper portion of the outer housing 17 and has a plurality of upwardly extended circumferentially spaced resilient latch or collet fingers 44 provided at their upper ends with outwardly projecting lugs **44*a*. These lugs 44*a* have upper downwardly and outwardly inclined surfaces 45 and lower downwardly and inwardly inclined surfaces 46, and the lugs are adapted to extend into an internal annular groove 47 within the upper connector sub 12 which provides an upper, downwardly and outwardly inclined surface 48 and a lower upwardly and outwardly inclined surface 49 between which the lugs 44*a* of the collet fingers 43 can be received, as later described. Above the groove 47 in the connector sub 12 is another annular groove 50 bordered at its bottom side by a downwardly and inwardly inclined surface 51, initially receiving the lugs 44*a***.

It will be seen that the lower collet or latch fingers 36 are substantially thicker and thus less yieldable than the upper collet fingers 44, so that the latching fingers 36 are relatively strong and the latching fingers 44 are relatively less strong.

Figure 3:
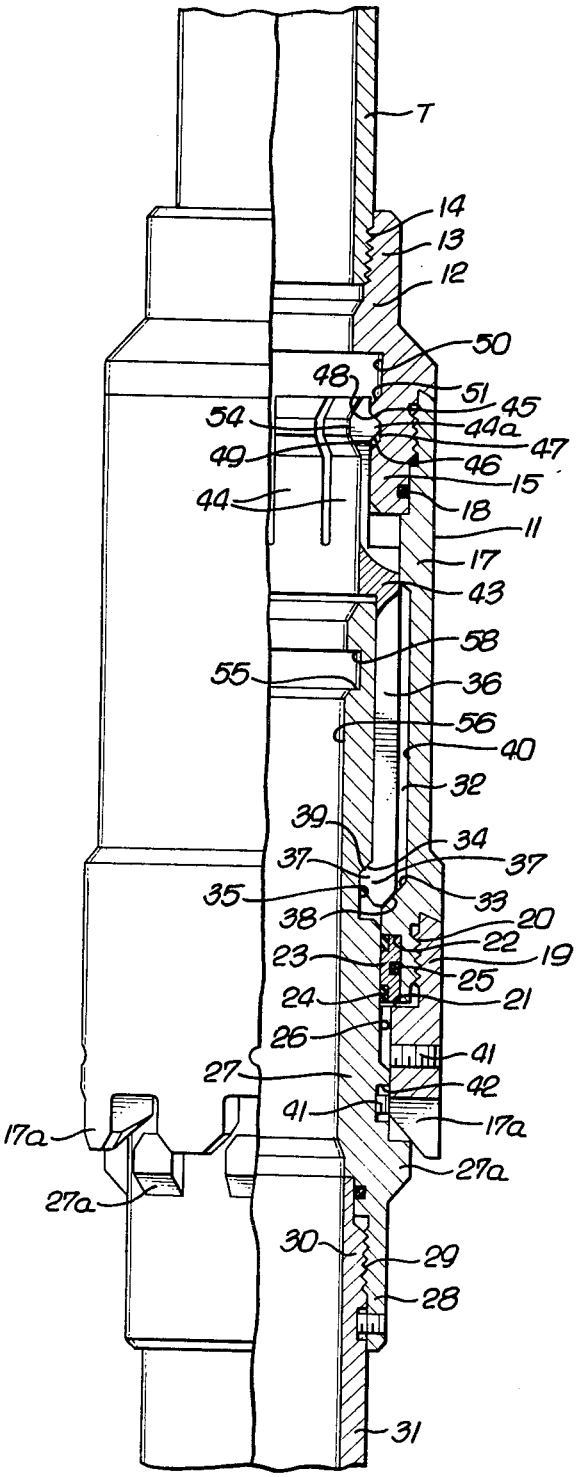
FIG. 3 is a view corresponding to FIG. 2, but showing the connector with tension applied, but locked against separation.

As a result of this latch construction, as can be seen in FIG. 3, when an upward tension is applied to the tubing T tending to move the outer connector body structure upwardly with respect to the mandrel 27, the shear screws 41 will be sheared. Because the collet or latch fingers 36 will not deflect outwardly under the same tensile force required to flex the latch or collet fingers 44 inwardly, the upper collet finger lugs **44*a* will be cammed inwardly over the upper surface 51 within the connector sub 12, as the connector body 17 moves upwardly, and will snap into the lower groove 46, at which time, the internal shoulder 33 of the housing 17 is engaged with the outer inclined surfaces 38 of the collet fingers 36 locking the collet lugs 37 beneath the downwardly facing mandrel shoulder 34, so that the upper body structure and the mandrel must move upwardly as unit. When the upper, outer body 11 is in the position of FIG. 3, the rotative lock lugs 17***a* and 27*a* are still engaged.

Figure 4:
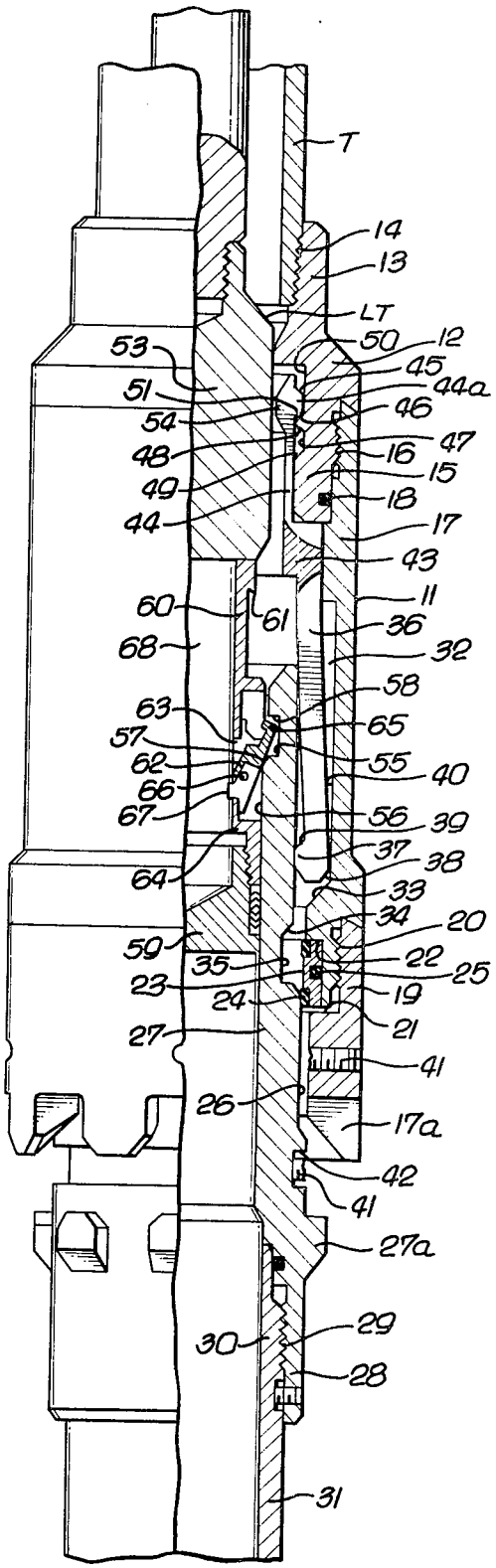
FIG. 4 is another view corresponding to FIGS. 2 and 3, but showing the connector following release by the landing of a probe in the connector and with a blanking plug latched in place.

However, as seen in FIG. 4, locking tool means LT are provided adapted to be lowered into the connector on a suitable wireline tool, to prevent inward flexure of the upper collet or latch fingers 44. The tool LT has a body 53 engageable by inner lugs 54 on the upper ends of the collet latches 44. Thus by installing the locking tool in place when the connector is in compression and the collet lugs 44*a* are in the groove 50, they are no longer free to flex inward and transfer to groove 46 upon upward movement of the upper body structure. However, since the upward facing, internal housing shoulder 33 is spaced downwardly from the lower inclined surface 38 of the lower latch fingers 36, there is adequate space for outward expansion of the lower ends of the lower latch fingers 36 by the camming action between the lug surfaces 39 and the mandrel surface 34, so that the outer, upper assembly can be removed upwardly from the mandrel by pulling upwardly on the tubing.

As also seen in FIG. 4, the inner body or seal mandrel 27, adjacent to its upper end, has an internal groove 55 disposed above a reduced inner bore 56. A landing shoulder 57 is formed at the lower side of the groove 55 and a downwardly facing shoulder 58 is provided at the top of the groove. This structure adapts the inner seal mandrel or body 27 to receive a blanking plug 59 which provides means for closing off the downwardly extending tubing when the connector is released and pulled from the well.

Blanking plugs, such as the plug 59 are well known and are adapted to be lowered through the tubing on a suitable running tool or wireline tool (not shown) engageable with the running and retrieving neck 60 which has a downwardly facing external shoulder 61 at its upper end for engagement with the running and retrieving tool. Latch dogs or pawls 62 are mounted in radial slots 63 in the body 64 of the blanking plug. The dogs have upper ends 65 adapted to swing outwardly for engagement beneath the shoulder 58 in the mandrel 27, about pivot pins 66 which mount the dogs in the slots 63. The dogs have lower retractor ends 67 which project inwardly into the bore 68 of the body 64 for engagement by the retrieving tool, whereby the dogs will be pivoted out of latching engagement with the shoulder 58 when the blanking plug is to be pulled.

From the foregoing, it will now be understood that the invention provides a simple sealing connector for tubing strings which can transmit tensile and set down forces through the tubing and can be released without rotational manipulation of the tubing string.

I claim:

1. A releasable connector for use in a well pipe string in a well bore comprising: an inner tubular body having lower means for connection with a downwardly extending pipe; an outer tubular body telescopically engaged with said inner body and having upper means for connection with an upwardly extending pipe; releasable means for releasably securing said bodies to each other; first latch means releasably secured to said outer body; second latch means connected to said first latch means and releasably secured to said inner body; said releasable means being released in response to initial longitudinal movement of said outer body upwardly of said inner body to release said outer body from said first latch means; first holding means on said outer body extending under and engaging said second latch means to hold said second latch means secured to said inner body; downward movement of said outer body relative to said first and second latch means disengaging said outer body from said second latch means and reconnecting said first latch means to said outer body to permit release of said second latch means from said inner body and allow said outer body to be elevated from said inner body.

2. A releasable connector as defined in claim 1; including sealing means slidably engaged between said bodies.

3. A releasable connector as defined in claim 1; said second latch means having flexible collet fingers having free ends provided with latch lugs; said inner body having a recess for receiving said lugs; said first holding means engaging said fingers for holding said lugs in said recess upon said initial longitudinal movement.

4. A releasable connector as defined in claim 1; said first and second latch means comprising circumferentially spaced collet fingers, said collet fingers of said second latch means releasably engaging said inner body and said collet fingers of said first latch means releasably engaging said outer body.

5. A releasable connector as defined in claim 4; said collet fingers of said second latch means being stronger than the collet fingers of said first latch means.

6. A releasable connector as defined in claim 4; said outer body having means providing axially spaced shoulders engageable by said collet fingers of said first latch means, said first holding means engaging said collet fingers of said second latch means when said collet fingers of said first latch means are engaged with one of said shoulders.

7. A releasable connector as defined in claim 6; said first holding means being spaced from said collet fingers of said second latch means when said collet fingers of said first latch means are engaged with the other of said shoulders.

8. A releasable connector as defined in claim 7; and second holding means for retaining said collet fingers of said first latch means engaged with said shoulder.

9. A releasable connector as defined in claim 8; said second holding means being a blocking member removably disposed behind said collet fingers of said second latch means.

10. A releasable connector as defined in claim 1; including seat means in said inner tubular body for receiving a blanking plug.

11. A releasable connector as defined in claim 1; including rotary lock means preventing relative rotation of said bodies when said bodies are coupled.

12. A releasable connector comprising an inner tubular body having an external shoulder between its ends; an outer tubular body having an internal shoulder opposing said external shoulder, said outer body having first and second longitudinally spaced grooves internally thereof; collet means between said bodies having first collet fingers having end lugs engaged with said internal shoulder and resiliently flexible to release said lugs from said internal shoulder; said collet means having second collet fingers having end lugs engageable with said grooves and flexible to allow movement of said bodies relatively longitudinally to shift said end lugs of said second collet fingers selectively into said first and second grooves upon opposite relative longitudinal movement of said bodies; said internal shoulder of said outer body engaging said first collet fingers to prevent flexing thereof when said lugs on said second collet fingers are in said first groove and said internal shoulder of said outer body being held spaced from said first collet fingers to permit flexing thereof when said lugs on said second collet fingers are in said second groove.

13. A releasable connector as defined in claim 12; including means for preventing movement of said lugs on said second collet fingers from said first groove to said second groove.

14. A releasable connector as defined in claim 12; including axially separable sealing means between said bodies engaged when said lugs on said first collet fingers are engaged with said internal shoulder.

15. In tubular structure adapted to extend into a well bore; a packer structure having means sealingly engageable and anchorable in the well bore, a tubing string connected with said packer structure, and a releasable tubing connector in said tubing string; said connector comprising: an inner tubular body; an outer tubular body telescopically engaged with said inner body; releasable means for releasably securing said bodies to each other, first latch means releasably secured to said outer body; second latch means connected to said first latch means and releasably secured to said inner body; said releasable means being released in response to initial longitudinal movement of said outer body upwardly of said inner body to release said outer body from said first latch means; first holding means on said outer body extending under and engaging said second latch means to hold said second latch means secured to said inner body; downward movement of said outer body relative to said first and second latch means disengaging said outer body from said second latch means and reconnecting said first latch means to said outer body to permit release of said second latch means from said inner body and allow said outer body to be elevated from said inner body.

16. A tubular structure as defined in claim 15; including sealing means between said bodies slidably coengaged and permitting said intiial movement.

17. A tubular structure as defined in claim 15; said second latch means comprising flexible collet fingers having free ends provided with latch lugs; said inner body having a recess for receiving said lugs; said first holding means engaging said fingers for holding said lugs in said recess upon said initial longitudinal movement.

* * * * *